US005845841A

United States Patent [19]

Canning

[11] Patent Number: 5,845,841

[45] Date of Patent: Dec. 8, 1998

[54] MULTI-PLY CARTON, BLANK AND METHOD OF FORMING THE BLANK

[75] Inventor: Timothy A. Canning, Raleigh, N.C.

[73] Assignee: Pac-Ipr, Inc., Raleigh, N.C.

[21] Appl. No.: 725,129

[22] Filed: Oct. 2, 1996

[51] Int. Cl.[6] ..... B65D 5/62; B05C 1/08; B31B 1/62

[52] U.S. Cl. ..... 229/116.5; 118/244; 118/258; 156/291; 156/578; 229/923; 492/31; 493/110; 493/333; 493/337; 493/393

[58] Field of Search ..... 229/87.19, 116.5, 229/923; 118/211, 244, 258; 156/270, 291, 578; 492/31, 33, 36; 493/110, 111, 333, 335, 337, 345, 380, 393, 471

[56] References Cited

U.S. PATENT DOCUMENTS

| | | | |
|---|---|---|---|
| 1,437,274 | 11/1922 | Smith | 229/923 |
| 2,018,070 | 10/1935 | Kreider, Jr. | 229/923 |
| 2,157,194 | 5/1939 | Webber et al. | 229/87.19 |
| 2,697,546 | 12/1954 | Bergstein | 493/110 |
| 2,769,588 | 11/1956 | Beck | 229/116.5 |
| 3,279,425 | 10/1966 | Gottscho | 118/37 |
| 3,391,673 | 7/1968 | Knapp et al. | 493/333 |
| 3,391,856 | 7/1968 | Siegler | 229/87.19 |
| 3,450,099 | 6/1969 | Petersen | 493/333 |
| 4,765,535 | 8/1988 | Michetti | 229/923 |
| 5,044,547 | 9/1991 | Hartman | 493/111 |
| 5,364,015 | 11/1994 | Hirschey | 229/116.5 |

*Primary Examiner*—Gary E. Elkins
*Attorney, Agent, or Firm*—John L. James; Erwin Dderr

[57] ABSTRACT

A multiply carton tray base or lid comprising a paperboard substrate (S) to which an outer sheet material (16) is secured. The tray has a main panel (m) across which the sheet material is stretched so that it is normally out of contact with a substantial part of the main panel and is secured to the tray only at locations internally of the carton side panels (s) and end panels (e) and not at all to the main panel (m).

9 Claims, 4 Drawing Sheets

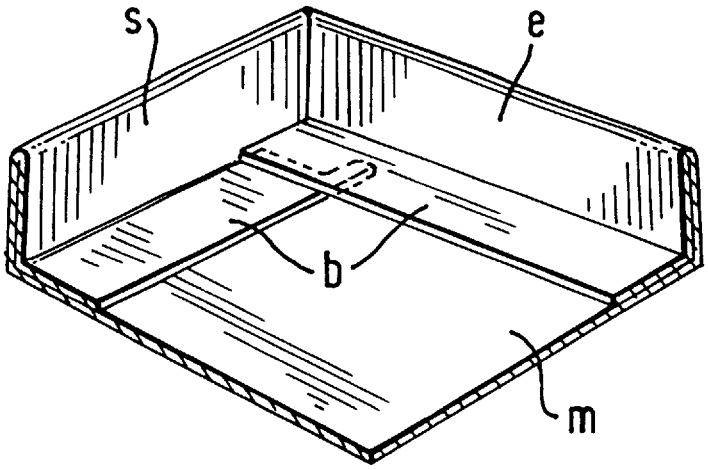
FIG. 6
FIG. 7
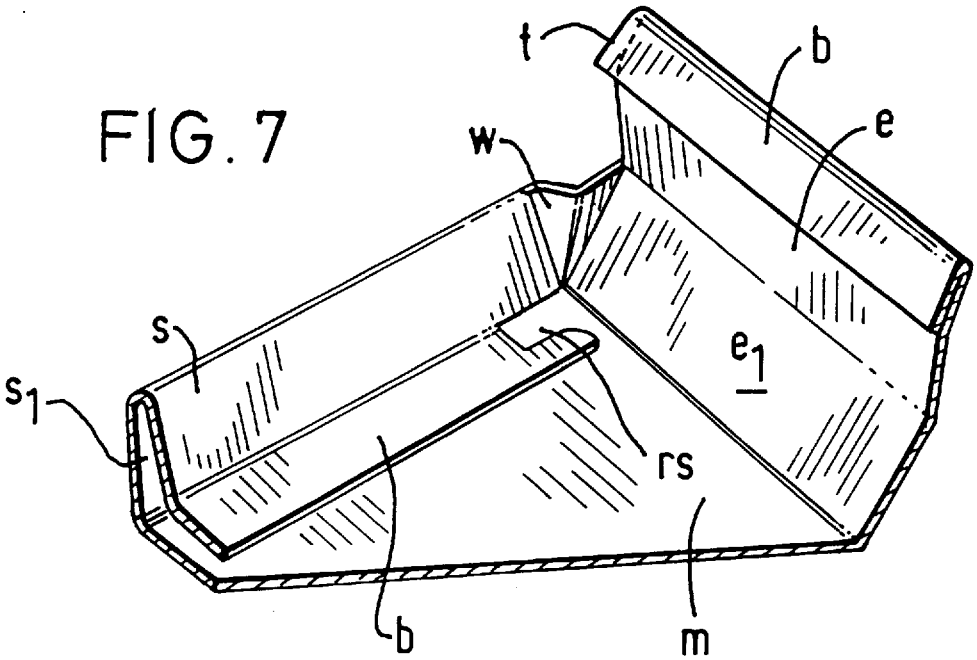
FIG. 8
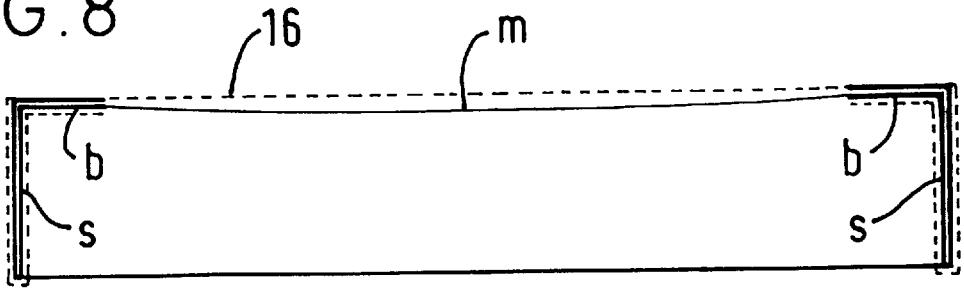

MULTI-PLY CARTON, BLANK AND METHOD OF FORMING THE BLANK

This invention relates to a multiply carton blank for setting up into a tray base or lid having a relatively loose outer ply imparting to the carton (formed from a combined base and lid) a hand-wrapped appearance. The invention also relates to a carton this provided, to a method of forming the multiply blank and further to means for forming the multiply blank.

More particularly, a preferred embodiment of the blank according to the invention comprises a paperboard substrate to one face of which is secured a decorative outer laminate such as a plastics 'foil' material. The laminate is secured to the paperboard substrate only at selected locations in order to achieve in the finished carton the desired 'hand-wrapped look', to facilitate the setting-up process and to ensure a neat appearance to the finished carton.

A machine which is specifically adapted and ideal for setting up carton blanks according to this invention is disclosed in international patent application number WO 96/14981 to which the reader is directed.

One aspect of the invention provides a multiply carton tray base or lid comprising a paperboard substrate structure to which an outer sheet material is secured the said tray having a main panel across which the sheet material is stretched so that it is normally out of contact with a substantial part of the main panel and which sheet material is secured to the tray only at locations internally thereof.

According to a feature of this aspect of the invention, the sheet material may be adhered to the paperboard structure only internally of the carton side panels and end panels and not at all to said main panel.

Another aspect of the invention provides a method of forming a multiply carton blank for setting up into a tray base or lid which method comprises feeding a web of material which is to form an outer ply of the blank from an in feed station to an outfeed station, applying adhesive to the exposed face of the web at preselected and interrupted transverse and longitudinal locations thereof during feeding of the web, between said stations, applying a paperboard layer to the pre-glued face of the web and cutting the multiply web thus formed at intervals along its length to create a plurality of multiply sheets. In some constructions, the multiply sheets may be cut and creased to form multiply carton blanks in which the cutting and creasing takes place first through the outer ply. Preferably, adhesive is applied to the outer ply in spaced longitudinal strips and i spaced transverse strips and at other discrete locations between the adjacent ends of each longitudinal and transverse strip.

According to another feature of this aspect of the invention, the longitudinal strips may be spaced apart so as to correspond with parts of the paperboard which are to become opposed end walls of the tray base or lid and the transverse strips are spaced apart so as to correspond with parts of the paperboard which are to become opposed side walls of the tray base or lid. Preferably, the discrete locations correspond with parts of the paperboard which are to become foldable webs hinged to adjacent ends of each of the side and end panels. Where this preference is adopted, the longitudinal strips may be spaced apart so as to correspond with parts of the paperboard which are to become the innermost end wall panels of double ply end walls of the tray base or lid and the transverse strips are spaced apart so as to correspond with parts of the paperboard which are to become the innermost side wall panels of double ply side walls of the tray base or lid.

Another aspect of the invention provides a multiply carton blank formed by a method according to any of the four immediately preceding paragraphs.

Yet another aspect of the invention provides in or for an applicator device for applying adhesive to a web of material which is to form an outer ply of a multiply carton blank, an applicator cylinder which includes adhesive applying areas comprising a pair of raised zones which will produce a generally rectangular adhesive pattern on said web, which zones at one of their adjacent transverse ends have a common transverse raised area and are spaced apart from one another at their opposite transverse ends. Preferably, a discrete raised area is provided at or adjacent each corner of each said zone.

A still further aspect of the invention provides a multiply carton blank for forming a tray base or lid which blank comprises a paperboard substrate to which an outer sheet material is secured, the blank comprising a main panel to each of a pair of opposite longitudinal edges of which is hinged a pair of side wall panels for forming respectively inner and outer side wall panels of a double ply side wall of the base or lid, and to each of a pair of opposite transverse edges of which is hinged a pair of end wall panels for forming respectively inner and outer end wall panels of a double ply side wall of the base or lid and wherein the outer sheet material is secured only to those areas of the paperboard substrate which will be disposed internally of the base or lid when the blank is set up and left detached from other areas of the blank.

According to a feature of this aspect of the invention, the ration of thickness between the paperboard substrate and the outer sheet material respectively is substantially within the range 18.75:1 to 65.5:1 but preferably within the range 25.1 to 35.1.

According to another feature of this aspect of the invention, the thickness of the paperboard substrate is substantially within the range of 0.015" to 0.025" and the thickness of the outer sheet material is substantially within the range 0.0004" to 0.0008".

Embodiments of the various aspects of the invention will now be described, by way of example only, with reference to the accompanying drawings, in which:

FIG. 6 is a perspective corner section of a tray base or lid viewed internally thereof;

FIG. 7 is a perspective corner section of a tray base or lid viewed internally thereof during set up; and FIG. 8 is a schematic cross-sectional view through a tray base or lid according to the invention.

Figure 1:
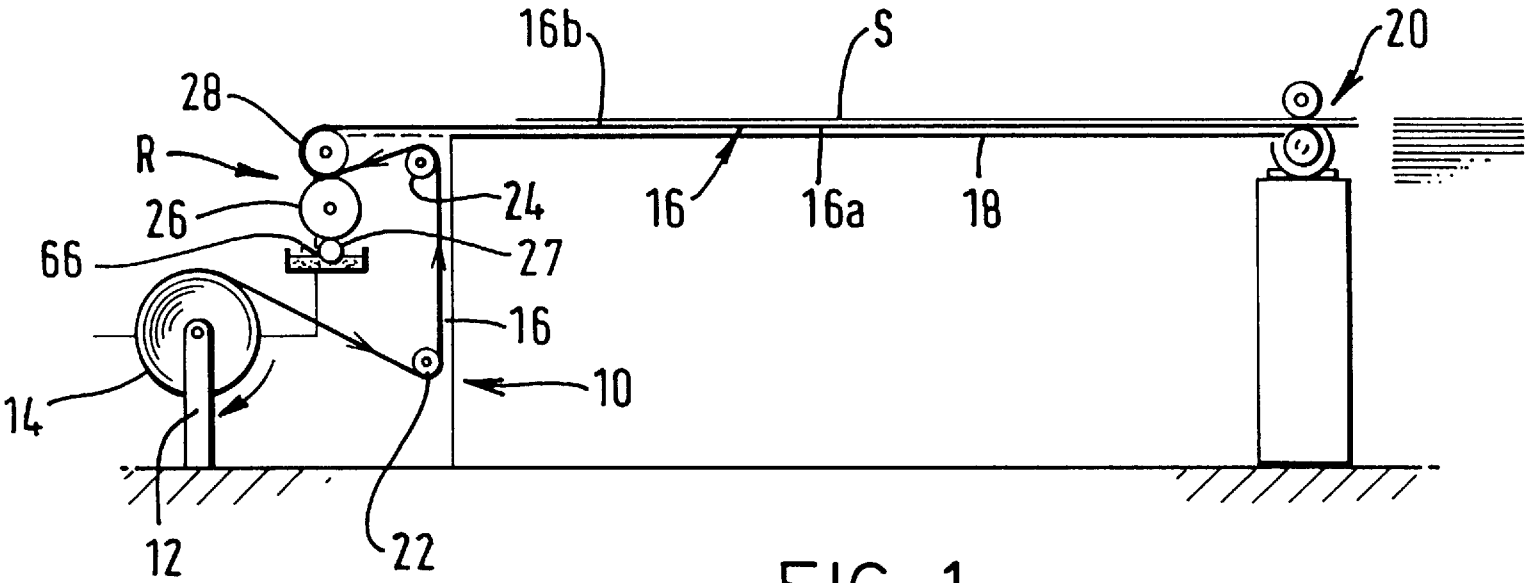
FIG. 1 is a schematic side view of the laminating equipment according to one aspect of the invention.

Referring first to FIG. 1, the infeed end 10 of the equipment includes a support 12 on which a roll 14 of laminate material 16 is journalled. Preferably the laminate material is a metallised and decorative plastics thin film of approximately 0.0006" or 13 microns thickness. However, the laminate material may be formed from other types of thin sheet material such as, by way of example only, a treated tissue paper.

The thickness of the paperboard substrate relative to the thin sheet material is important in order to provide a carton with the desired characteristics. Thus, the paperboard should not be too thin since otherwise a flimsy structure will result, nor too thick since then the material cost will be inhibiting and folding of the carton blank more difficult. Likewise, the thin sheet material should be thin enough to achieve a hand-wrapped 'wrinkle' appearance yet without being so thin that it is susceptible to tearing.

Accordingly, the ration of the thickness of the paperboard substrate to that of the thin sheet material is substantially within the range 18.75:1 to 62.5:1 but preferably within the range 25.1 to 35.1.

However, it is envisaged that the thickness of the paperboard substrate could be substantially within the range of 0.015" to 0.025" and the thickness of the thin sheet material substantially within the range 0.0004" to 0.0008".

A reasonably robust carton with the requisite 'hand-wrapped look' has been achieved with a paperboard thickness of 0.017" (17 point board) and a plastics film laminate thickness of 0.0006".

The film is printed with a decorative pattern or plain colour on one face 16*a* only, the other face 16*b* usually left undecorated but exhibiting the metallised finish on the underside of face 16*a*. The film passes through a set of rollers shown generally by reference 'R' at the infeed end of the equipment; passes over a processing platform 18 and through the nip of a set of drive rollers 20. One of the rollers 20 is powered by suitable means such as a small electric motor, to put the film under tension as the film is unravelled from the roll 14.

The set of rollers 'R' includes a pair of guide rollers 22, 24 respectively which direct the film between an applicator cylinder 26 and a co-operating transfer roller 28 which transfers drive to the applicator cylinder by movement of the film. Thus, the film passes through the nip between the applicator cylinder and the transfer roller such that its direction of travel is reversed by passing around the transfer roller. As the film is advanced along the processing platform its substantial engagement with transfer roller 28 causes the roller to rotate whereby rotational drive is transmitted to the applicator cylinder 26. To this end, the transfer roller is formed from a high friction material, such as rubber, which is in driving engagement with high friction parts of the applicator cylinder as described below.

Figure 2:
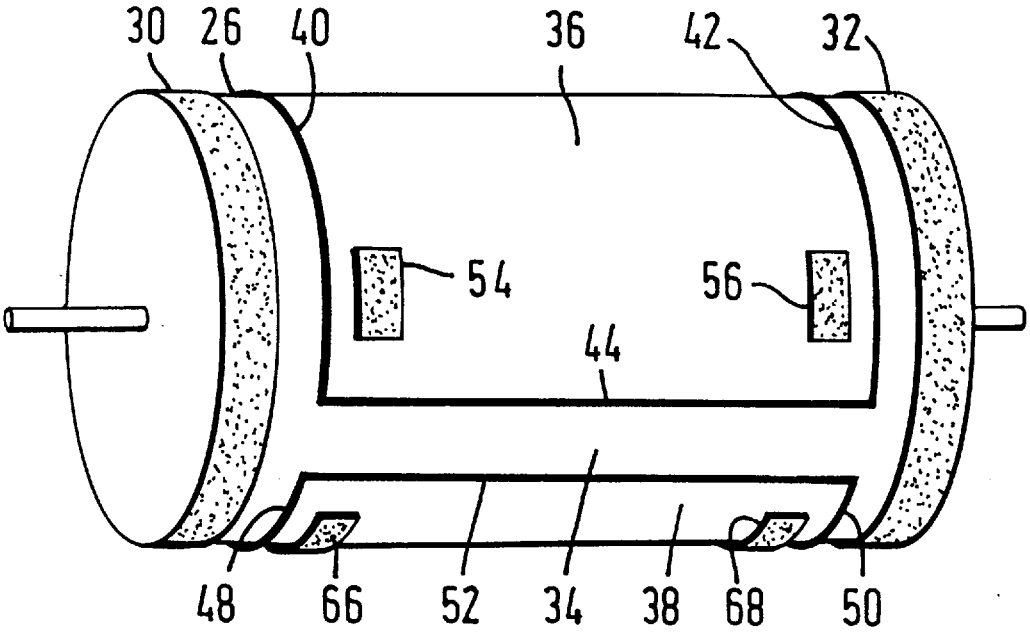
FIGS. 2 and 3 are perspective views of an adhesive roller applicator according to the invention for use in providing a tray base.
Figure 3:
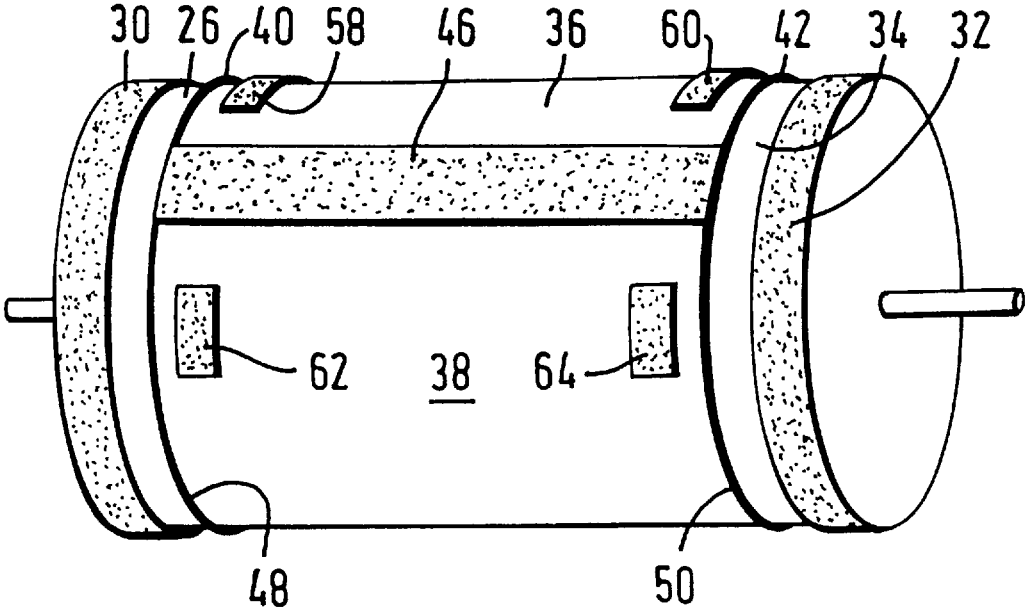

Referring now to FIGS. 2 and 3, the applicator cylinder 26 is illustrated so that its circumferential configuration is apparent. Cylinder 26 includes a circumferential band of high friction material 30, 32 at each of its opposite axial ends. These bands are raised from the surface 34 of the cylinder and engage with the transfer roller as referred to above.

The circumferential surface of the cylinder is provided with two zones 36 and 38 respectively which are defined by raised pads and which provide two side by side rectangular patterns of adhesive on a linear length of material passing through the nip between the applicator cylinder and the transfer roller during one full revolution thereof. For convenience, the zones on the cylinder will be referred to as 'rectangular' zones 36 and 38 respectively. Rectangular zone 36 is defined in part by spaced circumferential raised strips 40 and 42 respectively joined together at one of their ends by a transversely (axially) extending raised strip 44. At its opposite end (FIG. 3) the circumferential raised strips 40 and 42 are also joined together by a transversely extending raised strip 46. The transverse raised strip 46 is also common to rectangular zone 38 in that it joins together one end of circumferential raised strips 46, 50 which, in part, define the rectangular zone 38. The opposite ends of the circumferential raised strips 48, 50 are joined together by transverse raised strip 52. (FIG. 2).

The applicator cylinder also has further discrete raised pads within each rectangular zone. Thus, pads 54 and 56 are disposed adjacent the corners formed between strips 40 and 44 and between strips 42 and 44, respectively at one end of zone 36. Likewise, pads 58 and 60 are disposed adjacent the corners formed between strip 40 and 46 and between strips 42 and 46, respectively, at the opposite end of zone 36. Similarly, pads 62 and 64 are disposed adjacent the corners formed between strips 48 and 46 and between strips 50 and 46, respectively, at one end of zone 38. Likewise, pads 66 and 68 are disposed adjacent the corners formed between strips 48 and 46 and between strips 50 and 46 respectively, at the opposite end of zone 36. The particular applicator cylinder shown is particularly suitable for use in forming a blank to provide a tray base.

The precise layout of the circumferential and transverse strips and the disposition of all the further discrete pads is variable and is dependant upon the dimensions of the carton blank to be produced or, indeed, the number of carton blanks to be struck from the sheet. For example, in order to produce a blank to provide a tray top, the corner pads referred to above may be disposed fully within the corners of the rectangular zones so that they are contiguous with rather than adjacent the associated circumferential and transverse strips as shown. In some cases, where a larger blank is required only one rectangular zone may be required, whereas in other cases where smaller blanks are required, a multiplicity of rectangular zones may be required.

Referring again to FIG. 1, the applicator cylinder is in rolling abutment with a lower roller 27 which rotates in a bath of adhesive. When the applicator cylinder and lower roller rotate together, adhesive is transferred from the lower roller 27 to the raised strips and pads referred to above on the applicator cylinder axially within the circumferential bands 30 and 32. A doctor blade 66 is located adjacent the lower roller to rid it of excess adhesive.

Accordingly, as the web of material is fed adhesive is applied to it, on its non-treated face 16*b*, by the applicator cylinder, in a particular array so that a pattern of successive adhesive areas is exposed to view on the web as it is advanced along the processing table. In this regard, the width of the web is not sufficient to extend across circumferential bands 30 and 32 so that the bands are left free to frictionally engage the applicator cylinder.

Figure 4:
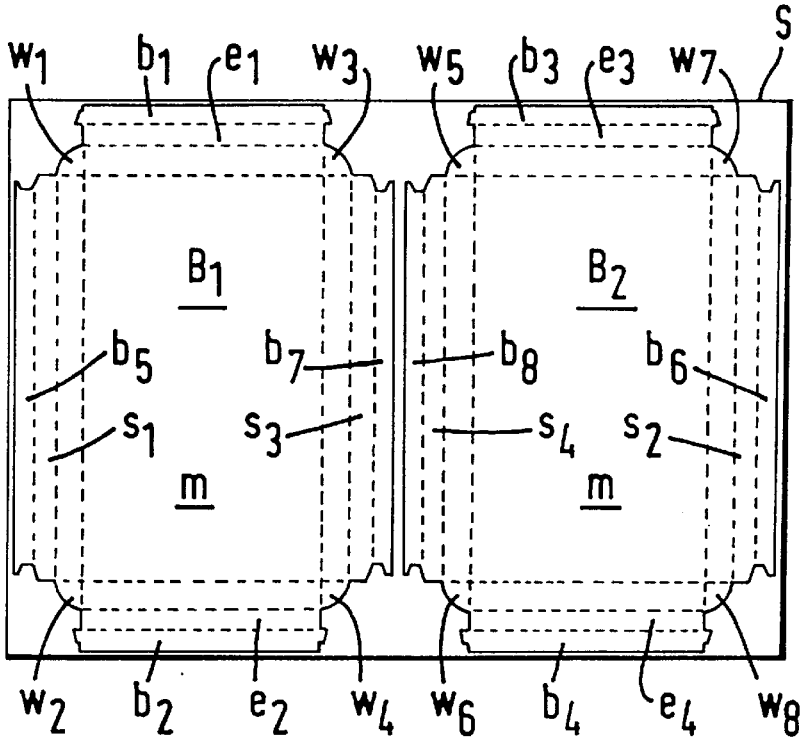
FIG. 4 is a plan view of a paperboard sheet prior to the application of adhesive to illustrate the layout of carton blanks to be struck from it.
Figure 5:
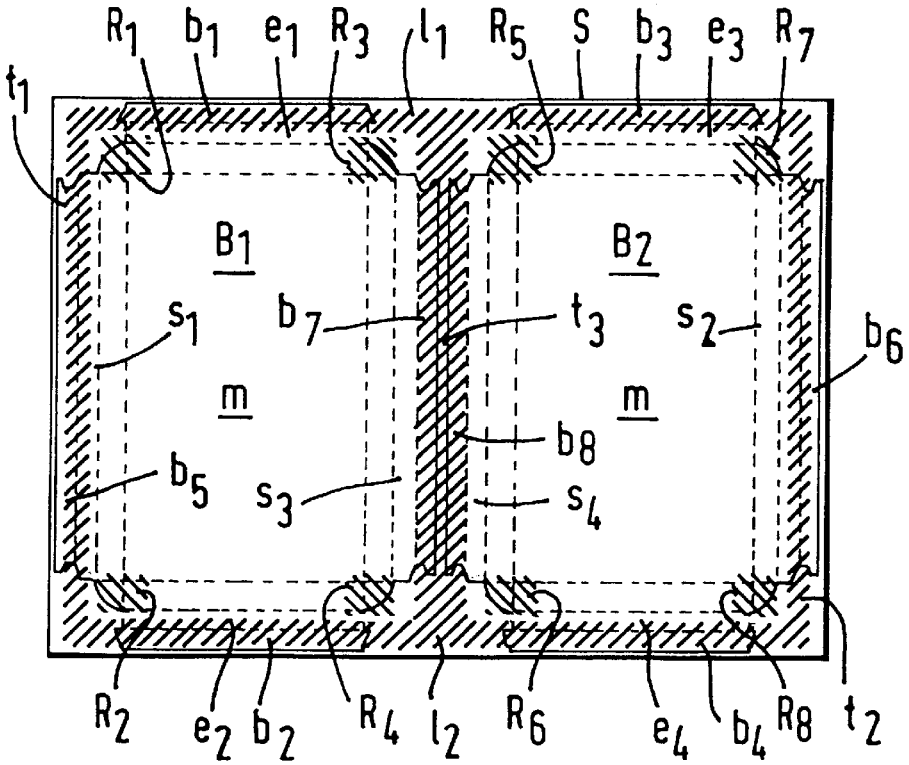
FIG. 5 is a view similar to FIG. 4 but shows the adhesive pattern applied to the sheet.

The paperboard substrate is superposed upon, and thereby adhered to, the film web as it is advanced along the processing table. In the particular embodiment shown, individual sheets of paperboard material 'S' are deposited upon the film web wherein each sheet is sized so that a pair of like carton blanks can be struck from it. However, a different number of carton blanks may be required from a similar or different sized sheet. This general arrangement is shown in FIG. 4. Thus, the pattern of adhesive which is laid down by one revolution of the applicator cylinder is intended to receive a paperboard sheet from which two blanks can be obtained. In FIG. 5, the outline of the two blanks $B_1$ $B_2$ to be struck from a sheet of paperboard 'S' is shown and the adhesive areas are shown by shading. It is nevertheless envisaged that a continuous web of paperboard material may be applied to the film web and the multi-ply web thus formed is sheeted thereafter rather than applying pre-sheeted paperboard to the web. It will be appreciated that the axial length of roller 27 is less than that of the applicator cylinder so that adhesive is transferred onto all the raised strips and pads inboard of the circumferential bands 30 and 32 but not on the circumferential bands themselves. Because the film web is fed under tension it is stretched under the paperboard substrate and this causes the paperboard to adopt a slightly upward arc or a so-called 'down-curl'. Paperboard exhibiting a down-curl is difficult to cut and crease and hence the multiply sheet is inverted and cut and creased in an up-curl disposition so that the cutting and creasing takes place first through the film outer ply.

FIG. 4 shown the layout of blanks $B_1$ $B_2$ on the paperboard sheet before the adhesive pattern is laid down. By comparing FIGS. 4 and 5, it will be seen that the longitudinal strips of adhesive $l_1$ and $l_2$ cover the foldable base panels $b_1$ and $b_2$ and portions of adjacent inner end panels $e_1$ and $e_2$ on blank $B_1$ and cover the foldable base panels $b_3$ and $b_4$ and portions of adjacent inner end panels $e_3$ and $3_4$ on blank $B_2$.

Similarly, the transverse trips of adhesive $t_1$ and $t_2$ cover foldable base panels $b_5$ $b_6$ and portions of adjacent inner side panels $s_1$ and $s_2$ on blanks $B_1$ and $B_2$ respectively whereas the central transverse strip of adhesive $t_3$ covers the foldable base panels $b_7$ and $b_8$ and portions of the adjacent inner side panels $s_3$ and $s_4$ on blank $B_1$ and $B_2$ respectively. The adhesive rectangles $R_1$ to $R_8$ in the main cover the foldable web panels $W_1$ to $W_8$. In this particular embodiment, the spacing between raised transverse strips 44 and 52 corresponds to the gap between successive sheets S laid down on the web 16.

Referring to FIGS. 6 and 7, the foldable base panels are thus called because when the blank is set up into a tray base or lid, the foldable base panels are disposed internally thereof in superposed contact with the main panel M of the blank. The inner side and end panels are thus called because when the blank is set up into a tray base of lid, the side and end panels are of double ply thickness in which the inner side and end panels are disposed internally of the tray base or lid. The web panels $W_1$ to $W_8$ are folded internally of the tray base or lid. The manner and means by which the carton blank is set up into a tray base or lid is described in the aforementioned international patent application No WO 96/14981.

It will be appreciated, therefore, that the lamination process of the present invention causes substantially all of the adhesive contact between the laminate material and paperboard substrate to be at locations which are not exposed to view in the set up tray base or lid. Accordingly, the 'loose' or 'hand' wrap effect of a carton formed from such a combined tray and lid is much enhanced because substantially none of the laminate which is seen externally of the carton is adhered to the paperboard. It has been found that the laminate material covering the foldable web panels $w_1$ $w_8$ is particularly susceptible to tearing because of the folding action performed on the webs which can lead to an unsatisfactory corner appearance in a finished carton and hence the adhesive contact between the laminate material and paperboard substrate is advantageous.

The 'loose' or 'hand' wrap appearance is also enhanced by the lack of any significant contact between the laminate material and the paperboard over a substantial area of the main panel. Tension of the laminate across the main panel is crated during the setting up of the precreased blank to produce a relatively taut skin over the main panel M which is thereby caused to adopt a substantially bowed configuration as shown in FIG. 8.

It has been found advantageous to the cutting and creasing operation and to the appearance and folding of the carton blank that the cutting and creasing operation by which the blanks are struck from the sheet should be performed through the laminate side of the sheet first rather than paperboard to laminate.

It is envisaged that the carton blanks may be partially pre-glued to facilitate set up. Therefore, in FIG. 7 the inner side walls 's' would be adhered to the outer side wall '$s_1$' and optionally the base panel 'b' adhered to the main panel 'm'. Accordingly, the double-ply side walls thus formed can be readily put into an upright attitude and the end wall panels e, $e_1$, and b are manipulated together with web panels w to provide upright double-ply end panels which are held in position by interlocking co-operation of the tab 'tb' and recess 'rs' in adjacent ends of respective base panels b. Other locking or securing means could be provided instead of the co-operating tab 'tb' and recess 'rs'. Moreover, it is further envisaged that the base panels of the end and/or side panels could be omitted altogether.

I claim:

1. A multiply carton tray base or lid formed from a blank including a main panel and, foldable joined thereto, side- and end wall panels, and comprising an outer decorative sheet material selectively adhered to said blank, said sheet material being dimensioned and arranged so that it is stretched across said main panel and disposed out of contact with a substantial portion of said main panel when said side wall panels are folded at an angle to said main panel.

2. The multiply carton tray base or lid according to claim 1, wherein said sheet material is adhered to said blank solely at or along the interior surfaces of said side- and end wall panels.

3. A method of forming a multiply carton blank arranged to be set up into a carton tray base or lid having a main panel and adjoining side- and end wall panels, the method comprising the steps of feeding a web of decorative material which is to form the outer ply of the blank from an infeed to an outfeed station, applying adhesive to the exposed upper surface of said web, applying a paperboard layer to said exposed upper surface of said web, cutting and creasing the multiply sheet so as to form a plurality of multiply blanks, characterized in that said cutting and creasing takes place through said outer ply.

4. The method according to claim 3, wherein said adhesive is applied in the form of spaced longitudinal strips and spaced transverse strips and at other discrete locations.

5. The method according to claim 4, wherein the longitudinal strips are spaced apart so as to correspond with parts of the paperboard which are to become opposed end walls of the tray base or lid and the transverse strips are spaced apart so as to correspond with the parts of the paperboard which are to become opposed side wall of the tray base or lid.

6. The method according to claim 5, wherein said discrete locations correspond with parts of the paperboard which are to become foldable webs hinged to adjacent ends of said side and end wall panels.

7. The method according to claim 6 as applied to a tray base or lid having side- and end walls of double ply construction, wherein the longitudinal strips are spaced apart so as to correspond with parts of the paperboard which are to become the inner end wall panels of the double ply end walls of the tray base or lid and the transverse strips are spaced apart so as to become the inner side wall panels of the double ply side walls of the tray base or lid.

8. A multiply carton blank formed by the method according to claim 3.

9. An applicator for applying adhesive to a web of material which is to form an outer ply of a multiply carton blank comprising an applicator cylinder which includes adhesive applying areas formed from raised zones which produce a generally rectangular peripheral adhesive pattern on said web, and wherein discrete raised areas are provided at or adjacent each corner of said rectangular peripheral adhesive pattern for applying adhesive in the corner areas.

* * * * *